US012234821B2

(12) United States Patent
Yang et al.

(10) Patent No.: US 12,234,821 B2
(45) Date of Patent: Feb. 25, 2025

(54) SCROLL COMPRESSOR AND METHOD FOR ASSEMBLING FIXED SCROLL OF SCROLL COMPRESSOR

(71) Applicant: Copeland Climate Technologies (Suzhou) Co. Ltd., Jiangsu (CN)

(72) Inventors: Erfeng Yang, Suzhou (CN); Sheng Liang, Suzhou (CN); Zhenfei Duan, Suzhou (CN)

(73) Assignee: Copeland Climate Technologies (Suzhou) Co. Ltd., Jiangsu (CN)

( * ) Notice: Subject to any disclaimer, the term of this patent is extended or adjusted under 35 U.S.C. 154(b) by 0 days.

(21) Appl. No.: 18/016,129

(22) PCT Filed: Oct. 27, 2020

(86) PCT No.: PCT/CN2020/123883

§ 371 (c)(1),
(2) Date: Jan. 13, 2023

(87) PCT Pub. No.: WO2022/011879

PCT Pub. Date: Jan. 20, 2022

(65) Prior Publication Data

US 2023/0272795 A1 Aug. 31, 2023

(30) Foreign Application Priority Data

Jul. 17, 2020 (CN) ..... 202010691274.5
Jul. 17, 2020 (CN) ..... 202021420547.4

(51) Int. Cl.
*F04C 18/02* (2006.01)
*F04C 29/00* (2006.01)

(52) U.S. Cl.
CPC ..... *F04C 18/02* (2013.01); *F04C 29/00* (2013.01); *F04C 2240/80* (2013.01)

(58) Field of Classification Search
CPC ..... F01C 1/0215; F01C 17/063; F01C 19/005; F04C 2240/50; F04C 27/005; F04C 2240/805
See application file for complete search history.

(56) References Cited

U.S. PATENT DOCUMENTS 5,088,906 A 2/1992 Richardson, Jr.
5,314,317 A 5/1994 Abe et al.
(Continued)

FOREIGN PATENT DOCUMENTS

CN 1197892 A 11/1998
CN 201568300 U 9/2010
(Continued)

OTHER PUBLICATIONS

CN-209164082-U English Translation (Year: 2019).*
(Continued)

*Primary Examiner* — Anthony Ayala Delgado
(74) *Attorney, Agent, or Firm* — Harness, Dickey & Pierce, P.L.C.

(57) ABSTRACT

Disclosed are a scroll compressor and a method for assembling a non-orbiting scroll of the scroll compressor. The scroll compressor includes: a scroll mechanism including a non-orbiting scroll which includes a non-orbiting scroll end plate and a non-orbiting scroll wrap and an outer peripheral wall; and a main bearing seat for supporting the scroll mechanism including a main body part and an axial seat portion whose inner peripheral surface is formed with a circumferential annular groove. The scroll compressor further includes an elastic ring provided between the outer peripheral wall and the axial seat portion and a push structure for forcing the elastic ring to expand radially outward, so that a part of the elastic ring in a radial direction is inserted into the circumferential annular groove to limit
(Continued)

axial movement of the non-orbiting scroll away from the main bearing seat.

15 Claims, 13 Drawing Sheets

(56) References Cited

U.S. PATENT DOCUMENTS

| | | | | |
|---|---|---|---|---|
| 5,897,306 | A | 4/1999 | Beck | |
| 6,146,119 | A | 11/2000 | Bush et al. | |
| 10,458,409 | B2 | 10/2019 | Su et al. | |
| 2015/0159652 | A1* | 6/2015 | Yamazaki | F04C 18/0261 418/55.5 |
| 2017/0350396 | A1 | 12/2017 | Su et al. | |

FOREIGN PATENT DOCUMENTS

| | | | | |
|---|---|---|---|---|
| CN | 105221419 | A | | 1/2016 |
| CN | 206636780 | U | | 11/2017 |
| CN | 207145228 | U | | 3/2018 |
| CN | 108869284 | A | | 11/2018 |
| CN | 209164082 | U | * | 7/2019 |
| CN | 111237188 | A | | 6/2020 |
| CN | 212928178 | U | | 4/2021 |
| JP | H06712 | A | | 1/1994 |

OTHER PUBLICATIONS

International Search Report (English and Chinese) and Written Opinion of the International Searching Authority (Chinese) issued in PCT/CN2020/123883, mailed Apr. 22, 2021; ISA/CN.
Chinese First Office Action regarding Application No. 202010691274.5, dated Dec. 11, 2024.

* cited by examiner

SCROLL COMPRESSOR AND METHOD FOR ASSEMBLING FIXED SCROLL OF SCROLL COMPRESSOR

This application is the national phase of International Application No. PCT/CN2020/123883 titled "SCROLL COMPRESSOR AND METHOD FOR ASSEMBLING FIXED SCROLL OF SCROLL COMPRESSOR" and filed on Oct. 27, 2020, which claims the benefit of priorities to the following two Chinese patent applications: Chinese Patent Application No. 202010691274.5 titled "SCROLL COMPRESSOR AND METHOD FOR ASSEMBLING FIXED SCROLL OF SCROLL COMPRESSOR", filed with the China National Intellectual Property Administration on Jul. 17, 2020; and Chinese Patent Application No. 202021420547.4 titled "SCROLL COMPRESSOR", filed with the China National Intellectual Property Administration on Jul. 17, 2020. The entire content of these applications is incorporated herein by reference.

FIELD

The present disclosure relates to a scroll compressor. The present disclosure further relates to a method for assembling non-orbiting scroll of the scroll compressor.

BACKGROUND

A scroll compressor generally includes a housing, a driving mechanism accommodated in the housing, a scroll mechanism driven by the driving mechanism, a main bearing seat supporting the scroll mechanism, and the like. The scroll mechanism generally includes an orbiting scroll and a non-orbiting scroll which are engaged with each other. On one hand, the non-orbiting scroll needs to be fixed in a circumferential direction relative to the main bearing seat to prevent the non-orbiting scroll from rotating around its axis. On the other hand, the non-orbiting scroll needs to be able to move slightly in an axial direction along its axis, thus providing some axial flexibility for the scroll mechanism.

In the prior art, the non-orbiting scroll is mostly fixed to the main bearing seat through a lug extending from the body of the non-orbiting scroll in cooperation with a guide sleeve and a fastener (screw). According to this installation method, the axial and circumferential movement of the non-orbiting scroll is limited under the condition of allowing the axial flexibility of the non-orbiting scroll, but it often requires large radial assembly space. Without changing the overall height of the compressor, the displacement of the scroll is generally increased by increasing the radial size of the scroll. Therefore, the conventional way of mounting the non-orbiting scroll with the lug in cooperation with guide sleeve and fastener is detrimental to the increase of the scroll displacement and the miniaturization of the compressor.

In addition, in the prior art, there is also a way to axially limit the non-orbiting scroll through a guide ring or a floating ring. The guide ring is arranged above the non-orbiting scroll and fixed to the main bearing seat with fasteners, thus limiting the axial movement of the non-orbiting scroll. The circumferential movement of the non-orbiting scroll can be limited by other features. This installation method still requires the use of fasteners to cooperate with the guide ring, which has certain requirements for the strength of the guide ring and fasteners, and also requires a certain radial assembly space, and the installation process is difficult and time-consuming.

Therefore, there is a need to improve the installation mode of the non-orbiting scroll, so as to make the installation of the non-orbiting scroll easier and increase the displacement of the scroll without increasing the size of the compressor.

SUMMARY

An object of the present disclosure is to solve or at least alleviate at least one of the above problems, that is, to provide a scroll compressor and a method for assembling a non-orbiting scroll of the scroll compressor, the scroll compressor and the scroll compressor assembled by the method for assembling can realize the radial centering and axial flexibility of the non-orbiting scroll, and the installation process is simpler, and the radial space design inside the compressor can be fully optimized, so that the displacement of the scroll compressor can be further increased without increasing the size of the scroll compressor.

According to an aspect of the present disclosure, there is provided a scroll compressor, comprising: a scroll mechanism, which includes a non-orbiting scroll, the non-orbiting scroll includes a non-orbiting scroll end plate and a non-orbiting scroll wrap and an outer peripheral wall extending from one side of the non-orbiting scroll end plate, the outer peripheral wall is arranged at a periphery of the non-orbiting scroll wrap; and a main bearing seat, the main bearing seat is configured for supporting the scroll mechanism and includes a main body part and an axial seat portion extending axially from the main body part, a circumferential annular groove is formed at an inner peripheral surface of the axial seat portion. The scroll compressor further includes an elastic ring arranged between the outer peripheral wall and the axial seat portion and a pushing structure configured for forcing the elastic ring to expand radially outward, so that a part of the elastic ring in a radial direction is inserted in the circumferential annular groove to limit axial movement of the non-orbiting scroll away from the main bearing seat.

Optionally, the outer peripheral wall, along an axial direction, comprises a first wall portion and a second wall portion, a step portion is provided between the first wall portion and the second wall portion, and the elastic ring is arranged on the step portion.

Optionally, the pushing structure includes a mounting hole provided at the step portion and an expansion pin which is mounted in the mounting hole and is configured for pushing the elastic ring radially outward.

Optionally, the firs wall portion is provided with a cutting part at a position corresponding to the mounting hole.

Optionally, the main bearing seat, along the axial direction, comprises a first seat portion and a second seat portion, the first seat portion is provided with the circumferential annular groove and is arranged opposite to the first wall portion, the second seat portion is arranged opposite to the second wall portion, an inner peripheral surface of the second seat portion cooperates with an outer peripheral surface of the second wall portion to limit radial movement of the non-orbiting scroll relative to the main bearing seat.

Optionally, an outer diameter of the elastic ring in its free state is smaller than an inner diameter of the first seat portion, an inner diameter of the elastic ring is larger than an outer diameter of the first wall portion.

Optionally, the expansion pin is configured as a hollow spring pin with openings at both ends and having a longitudinal slot, as a cylindrical positioning pin provided with external threads, or as a positioning pin with a head at one end and a flat part extending in an axial direction of the expansion pin at the head.

Optionally, the elastic ring is configured as a circular ring with an opening.

Optionally, a radial dimension of the part of the elastic ring located in the circumferential annular groove is greater than ½ of a radial depth of the circumferential annular groove.

Optionally, an axial thickness of the elastic ring is smaller than an axial height of the circumferential annular groove.

Optionally, the elastic ring is configured not to be fixed to the non-orbiting scroll or the main bearing seat, so that it can float in an axial direction along with axial movement of the non-orbiting scroll.

Optionally, a first semi-circular groove and a second semi-circular groove are respectively formed on an outer peripheral surface of the outer peripheral wall and the inner peripheral surface of the axial seat portion, the first semi-circular groove and the second semi-circular groove cooperate with each other to form a circular-hole shaped groove, and an anti-rotation pin accommodated in the circular-hole shaped groove is provided, thereby limiting circumferential movement of the non-orbiting scroll relative to the main bearing seat.

According to another aspect of the present disclosure, a method for assembling the non-orbiting scroll of the scroll compressor described above is further provided, which includes: arranging the non-orbiting scroll into the main bearing seat; arranging the elastic ring on a step portion provided at the outer peripheral wall of the non-orbiting scroll; and inserting an expansion pin of the pushing structure into a mounting hole, arranged at the step portion, of the pushing structure from a radial inner side of the elastic ring, so that the elastic ring expands radially outward and a part of the elastic ring in the radial direction is inserted in the circumferential annular groove formed at the inner peripheral surface of the axial seat portion of the main bearing seat.

Optionally, the method includes when arranging the non-orbiting scroll into the main bearing seat, aligning a first semi-circular groove formed on an outer peripheral surface of the outer peripheral wall and a second semi-circular groove formed on the inner peripheral surface of the axial seat portion to form a circular-hole shaped groove, and the assembly method further comprising inserting an anti-rotation pin into the circular-hole shaped groove.

Optionally, the step of inserting the expansion pin into the mounting hole from the radial inner side of the elastic ring comprises: after a first one of the expansion pins is inserted into the mounting hole, expanding the elastic ring radially outward by using a tooling, and removing the tooling after the remaining expansion pin(s) is/are all inserted into it/their corresponding mounting hole(s).

According to the present disclosure, the radial centering and axial flexibility of the non-orbiting scroll can be reliably realized, and the mounting process is more convenient, and the radial space design inside the compressor can be fully optimized, so that the displacement of the scroll compressor can be further increased without increasing the size of the scroll compressor.

BRIEF DESCRIPTION OF THE DRAWINGS

The features and advantages of one or more embodiments of the present disclosure will become more readily understood from the following description with reference to the accompanying drawings. The drawings described herein are for illustrative purposes only, and are not intended to limit the scope of the present disclosure in any way. The figures are not to scale and some features may be exaggerated or minimized to show details of particular components. In the drawings.

DETAILED DESCRIPTION OF THE EMBODIMENTS

Preferred embodiments of the present disclosure are described below with reference to the accompanying drawings, which are merely exemplary and do not constitute limitations on the present disclosure and its application.

Figure 1:
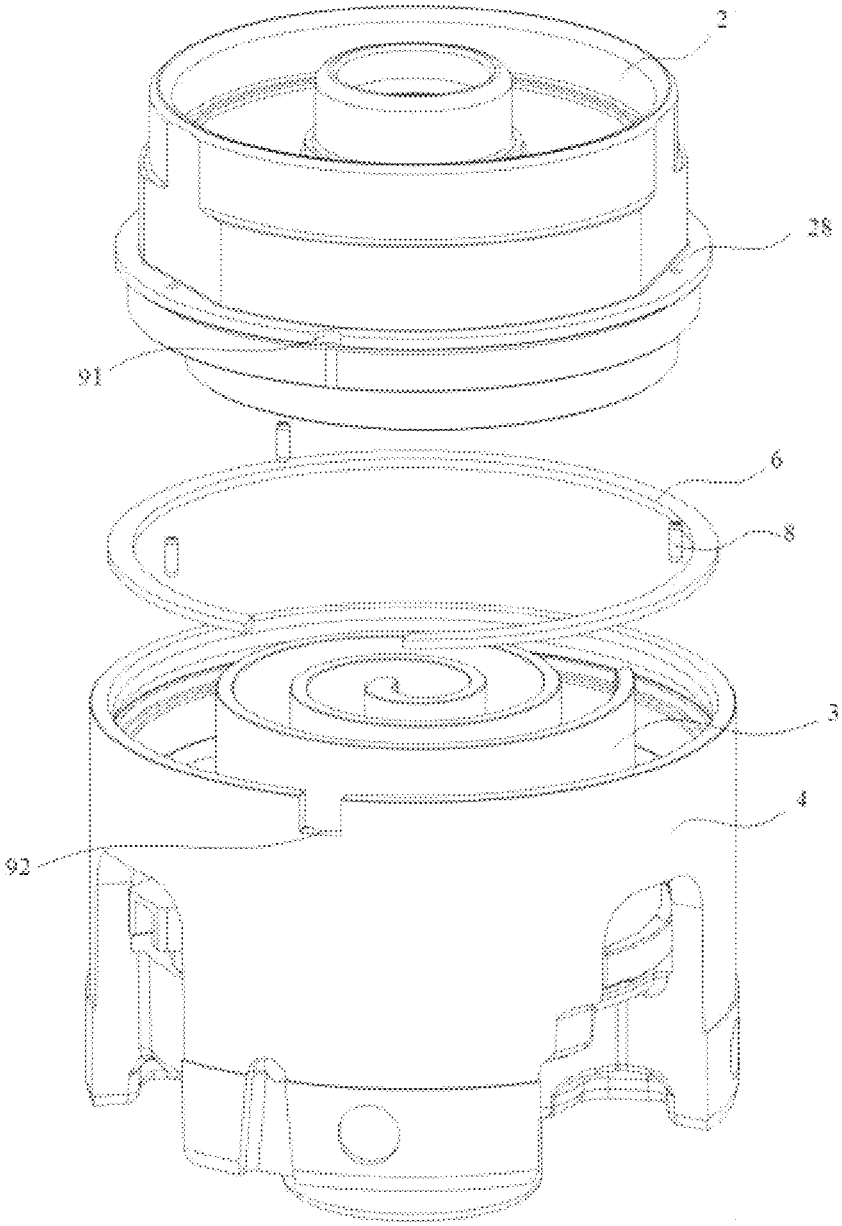
FIG. 1 is an exploded schematic perspective view of a scroll mechanism and a main bearing seat according to an exemplary embodiment of the present disclosure.

Referring to FIG. 1, the scroll compressor mainly includes a housing (not shown), a scroll mechanism, a main bearing seat 4 and a driving mechanism (not shown). The scroll mechanism includes a non-orbiting scroll 2 and an orbiting scroll 3. The driving mechanism is configured to drive the orbiting motion of the orbiting scroll 3 relative to the non-orbiting scroll 2 (that is, the central axis of the orbiting scroll moves around the central axis of the non-orbiting scroll, but the orbiting scroll does not rotate around its central axis) to compress the working fluid.

Figure 3:
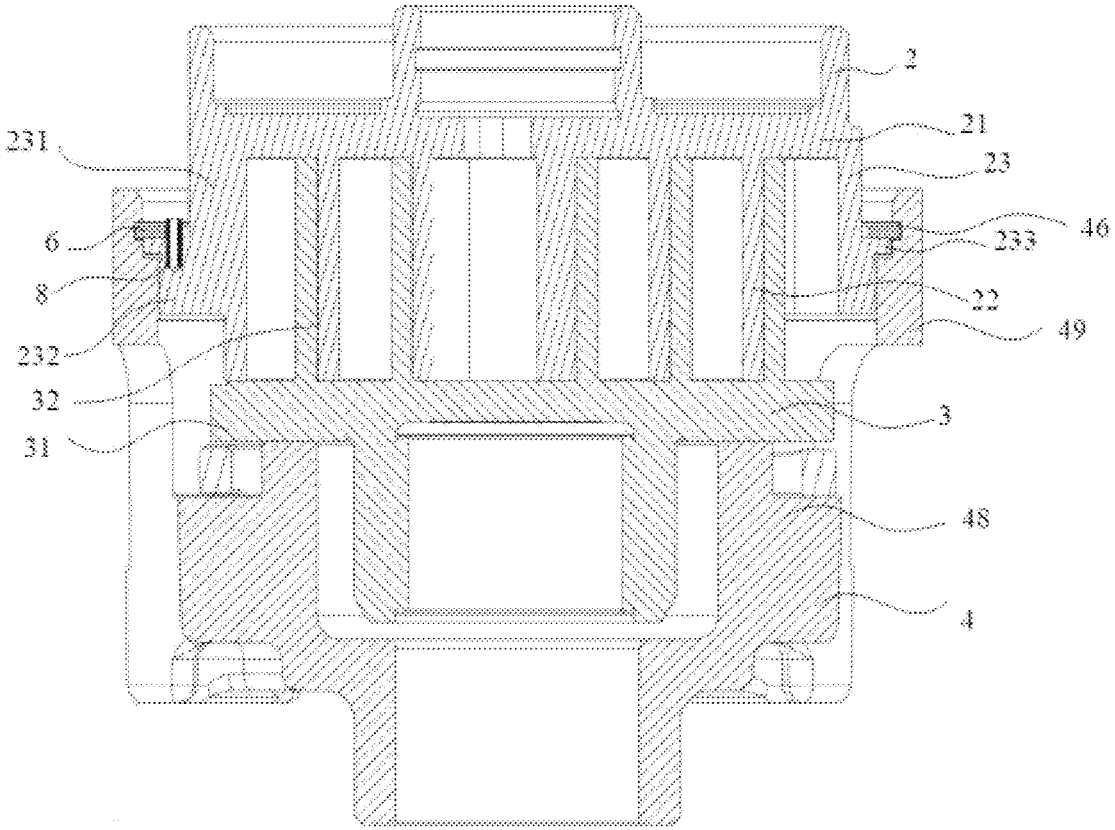
FIG. 3 is a longitudinal sectional view of the scroll mechanism and the main bearing seat according to the exemplary embodiment of the present disclosure.

The non-orbiting scroll 2 may be fixed relative to the housing in any suitable manner, and mounted to the main bearing seat 4 as illustrated in the present disclosure, which is to be described in detail hereinafter. As shown in FIG. 3, the non-orbiting scroll 2 may include a non-orbiting scroll end plate 21 and a non-orbiting scroll blade 22 (that is, the non-orbiting scroll wrap) extending from one side of the non-orbiting scroll end plate 21.

The orbiting scroll 3 may include an orbiting scroll end plate 31 and an orbiting scroll blade 32 (that is, the orbiting scroll wrap) formed on a side of the orbiting scroll end plate 31. The non-orbiting scroll blade 22 and the orbiting scroll blade 32 can be engaged with each other, so that a series of moving compression chambers with volume gradually decreasing from a radial outer side to a radial inner side are formed between the non-orbiting scroll blade 22 and the orbiting scroll blade 32 during operation of the scroll compressor, so as to compress the working fluid.

The main bearing seat 4 is adapted to support the orbiting scroll end plate 31 of the orbiting scroll 3. The orbiting scroll end plate 31 orbits on a supporting surface of the main bearing seat 4. The main bearing seat 4 could be fixed with respect to the housing of the scroll compressor by any suitable means.

In order to achieve fluid compression, an effective seal is required between the non-orbiting scroll 2 and the orbiting scroll 3.

On the one hand, during the normal operation of the scroll compressor, Radial sealing is required between a side surface of the non-orbiting scroll blade 22 and a side surface of the orbiting scroll blade 32. The radial sealing between the two scroll blades is generally realized by a centrifugal force of the orbiting scroll 3 during operation and a driving force provided by the driving device. In a case that incompressible foreign matter (e.g., solid impurities and liquid refrigerant) enters the compression chamber and gets stuck between the scroll blades 22 and 32, the scroll blades 22 and 32 can be temporarily separated from each other in the radial direction to allow the foreign matter to pass through, thereby preventing the scroll blades 22 and 32 from being damaged, so as to provide the scroll compressor with radial flexibility.

On the other hand, during the normal operation of the scroll compressor, axial sealing is required between a top of the non-orbiting scroll blade 22 and the end plate 31 of the orbiting scroll 3, and is required between a top of the orbiting scroll blade 32 and the end plate 21 of the non-orbiting scroll 2. In a case that the compression chamber of the scroll compressor has excessive pressure, the fluid in the compression chamber leaks to the low-pressure side through a gap between the top of the orbiting scroll blade 22 and the orbiting scroll end plate 31 and a gap between the top of the orbiting scroll blade 32 and the non-orbiting scroll end plate 21 to achieve unloading, thereby providing the scroll compressor with axial flexibility.

Figure 2:
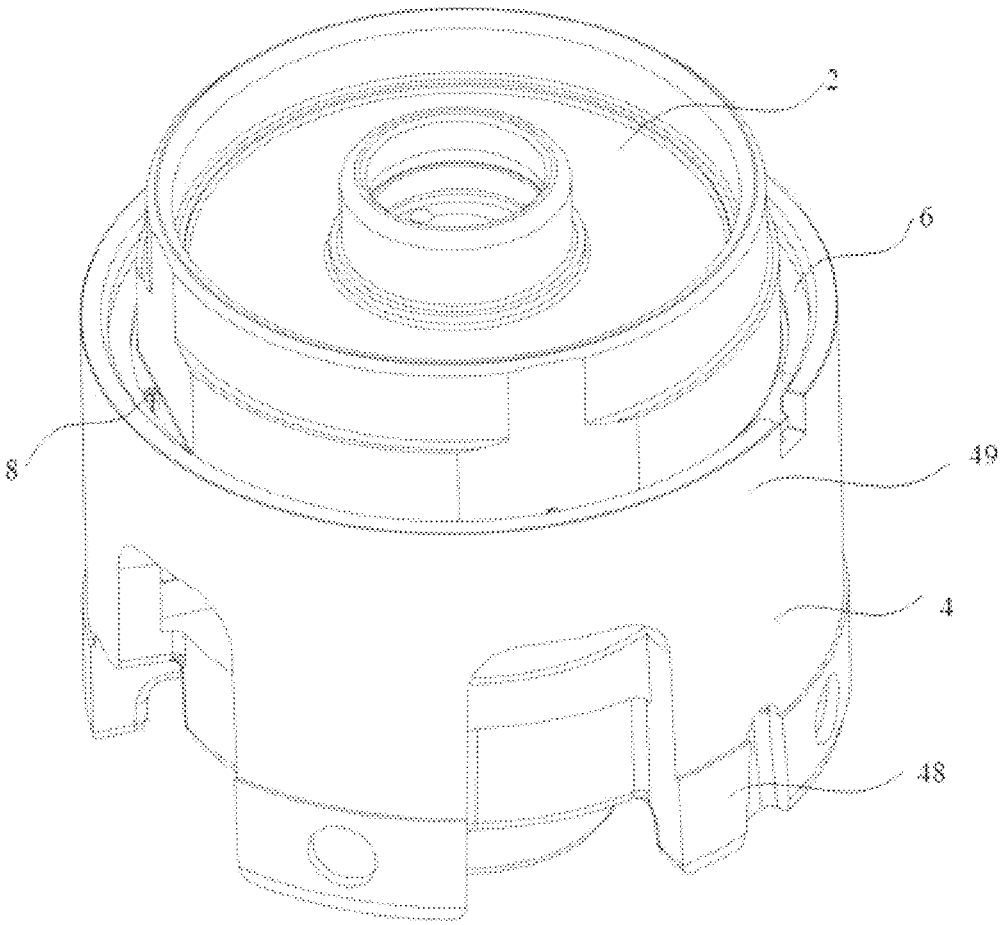
FIG. 2 is a schematic perspective view of the assembly of the scroll mechanism and the main bearing seat according to the exemplary embodiment of the present disclosure.

In order to provide axial flexibility, the exemplary embodiment of the present disclosure provides a structure in which the non-orbiting scroll 2 is held in the main bearing seat 4 by the elastic ring 6. Referring to FIG. 1, FIG. 2 and FIG. 3, the main bearing housing 4 includes a main body part 48 extending in a radial direction, on which a thrust surface is formed to support the orbiting scroll end plate 31. The main bearing seat 4 further includes a generally cylindrical axial seat portion 49 extending axially upward from the main body part 48, the axial seat portion 49 constitutes a space for accommodating the orbiting scroll 3 and the non-orbiting scroll 2. A circumferential annular groove 46 is formed at the inner peripheral surface of the axial seat portion 49 for accommodating a part of the elastic ring 6.

The non-orbiting scroll 2 includes a substantially cylindrical outer peripheral wall 23 extending from one side of the non-orbiting scroll end plate 21 and disposed on the periphery of the non-orbiting scroll blade 22 (i.e., the non-orbiting scroll wrap), the outer peripheral wall 23 includes a first step portion 233 extending in the radial direction (corresponding to the step portion 233 according to the present disclosure), the elastic ring 6 is arranged between the outer peripheral wall 23 and the axial seat portion 49 and is disposed on the first step portion 233. The first step portion 233 is further provided with mounting holes 28 distributed circumferentially for being fitted with the expansion pin 8. The mounting hole 28 is configured as a blind hole, and forms a pushing structure together with the expansion pin 8 that forces the elastic ring 6 to expand radially outward. By inserting the expansion pin 8 into the mounting hole 28, the expansion pin 8 pushes the elastic ring 6 radially outward from the radially inner side of the elastic ring 6, forcing the elastic ring 6 to expand outward in the radial direction, so that a part of the elastic ring 6 in the radial direction is kept in the circumferential annular groove 46 to limit the axial movement of the non-orbiting scroll 2 away from the main bearing seat 4.

A clearance fit in the axial direction is formed between the circumferential annular groove 46 and the elastic ring 6, which means that the elastic ring 6 can be freely inserted into the circumferential annular groove 46, and the elastic ring 6 can move axially relative to the circumferential annular groove 46 within a predetermined range after it is seated in the circumferential annular groove 46, thereby realizing the axial floating of the non-orbiting scroll 2.

The exemplary embodiment of the present disclosure uses the elastic ring 6 coordinated with the circumferential annular groove 46 to limit the axial position of the non-orbiting scroll 2. Because the conventional lug and other structures are omitted, the radial space in the compressor can be saved, which is beneficial to increase the displacement of the scroll without increasing the overall size of the compressor. Although there are expansion pins 8 in this exemplary embodiment, the expansion pins 8 are not a conventional fastener used to fixedly connect the non-orbiting scroll or floating ring with the main bearing seat, the function of the expansion pins is to make the elastic ring 6 expand in the radial direction, so the strength requirement of the expansion pin 8 is less, the occupied radial mounting space can be reduced, and the mounting is more convenient. On the other hand, the elastic ring 6 is configured not to be fixed to the non-orbiting scroll 2 or the main bearing seat 4, so that it can float in the axial direction with the axial movement of the non-orbiting scroll 2, which further omits fasteners, so that the axial flexible structure according to the present disclosure is simpler and easier to mount.

The various components regarding the axial floating of the non-orbiting scroll are described below, including the main bearing seat 4, the non-orbiting scroll 2, the elastic ring 6, the expansion pin 8, etc.

Figure 4A:
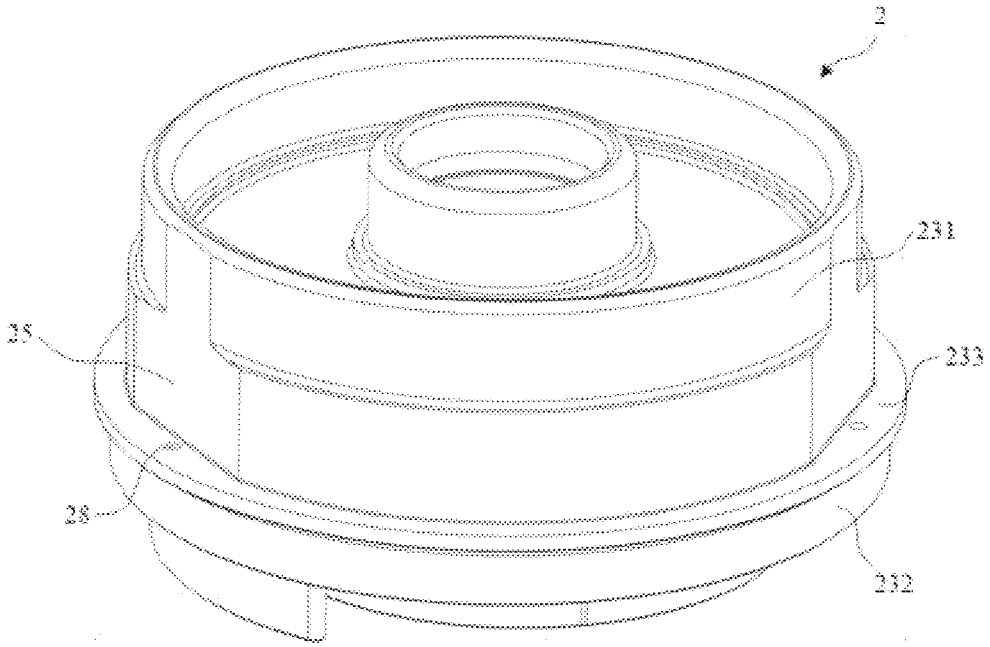
FIG. 4*a* is a schematic perspective view of a non-orbiting scroll according to the exemplary embodiment of the present disclosure.
Figure 4B:
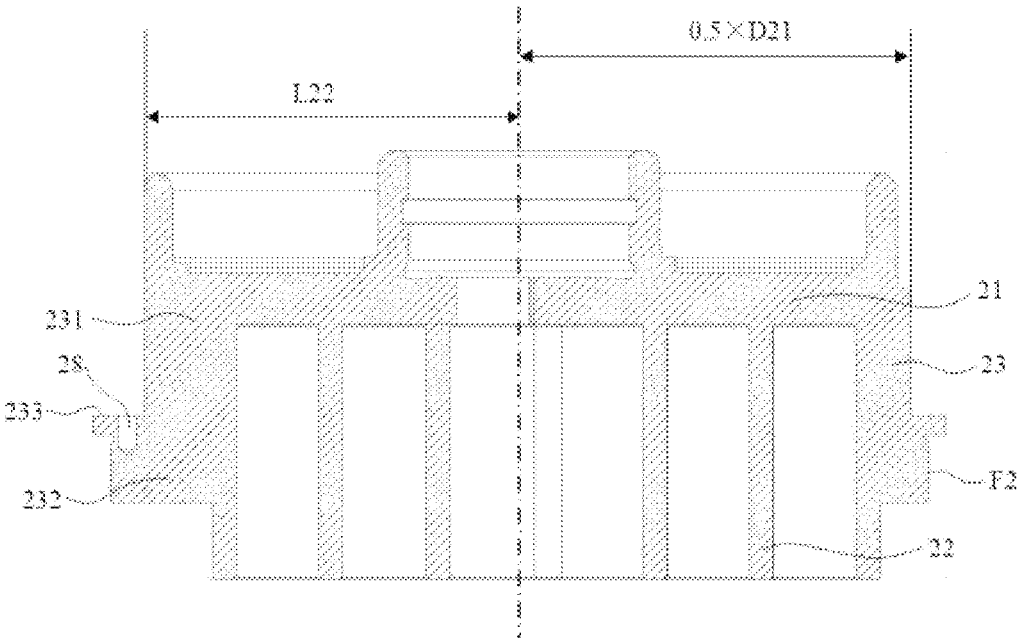
FIG. 4*b* is a longitudinal sectional view of a non-orbiting scroll according to the exemplary embodiment of the present disclosure.
Figure 4C:
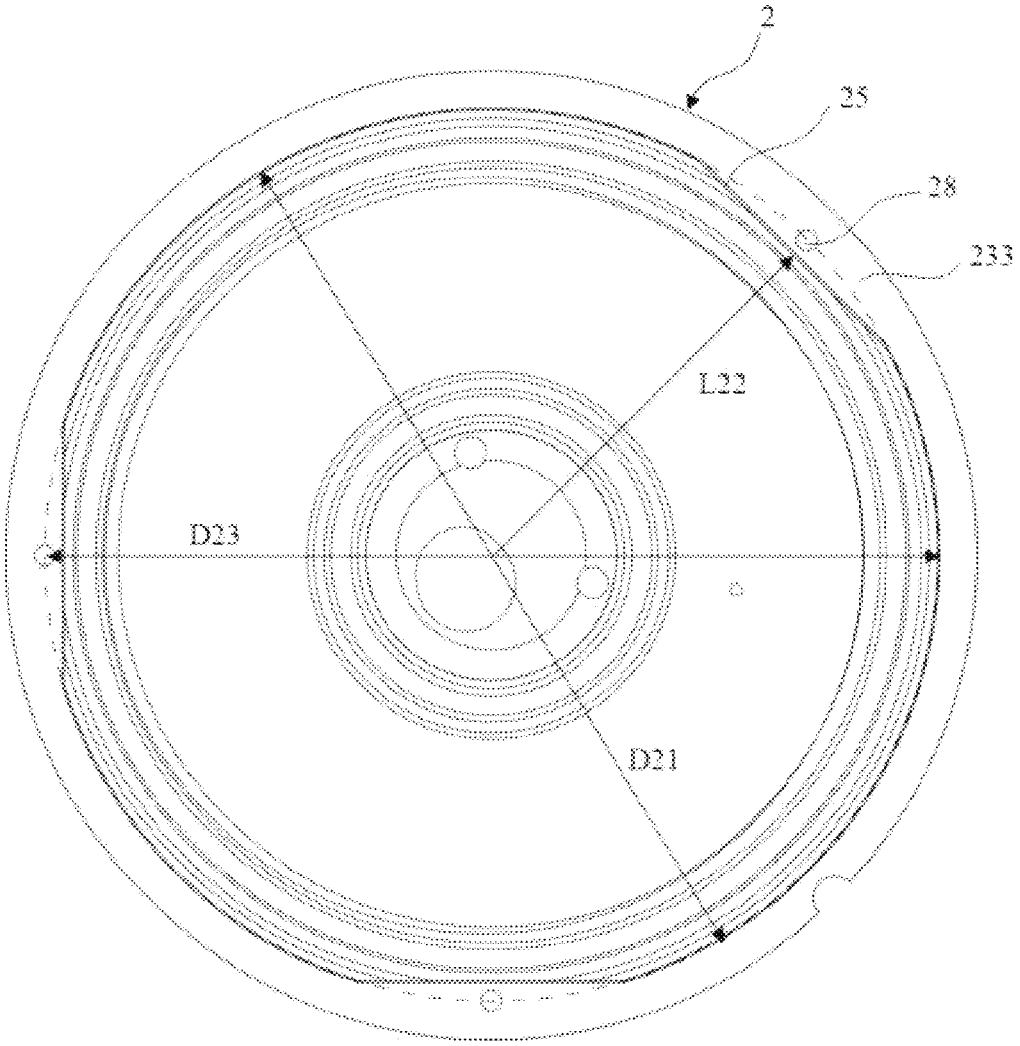
FIG. 4*c* is a top view of the non-orbiting scroll according to the exemplary embodiment of the present disclosure.

The specific structure of the non-orbiting scroll 2 is described below with reference to FIG. 4*a*, FIG. 4*b* and FIG. 4*c*. The outer peripheral wall 23 of the non-orbiting scroll 2, along the axial direction, includes a first wall portion 231 and a second wall portion 232, an outer diameter D21 of the first wall portion 231 is smaller than an outer diameter of the second wall portion 232, thereby forming a first step portion 233 between the first wall portion 231 and the second wall portion 232. The first step portion 233 may be configured such that the radially outermost surface thereof is flush with the radially outermost surface of the second wall portion 232, or as shown in FIG. 4*b*, the first step portion 233 protrudes radially outward relative to the second wall portion 232, thereby providing more support for the elastic ring 6. Two or more mounting holes 28 distributed in the circumferential direction are formed on the first step portion 233, and the diameter of the circle where the mounting holes 28 are located is D23. The mounting hole 28 is configured as a blind hole for mounting the expansion pin 8. Preferably, the first wall portion 231 is provided with a cutting part 25 at a position corresponding to the mounting hole 28 in the circumferential direction. The cutting part 25 may be formed by cutting the radially outer side surface of the first wall portion 231 in the axial direction, so that the distance L22 from the axis of the non-orbiting scroll 2 to the plane where the cutting part 25 is located is smaller than half of the outer diameter D21 of the first wall portion 231. The arrangement of the cutting part 25 can reserve more design space for the mounting hole 28 and the expansion pin 8, and further facilitate the assembly of the expansion pin 8. The outer peripheral surface of the second wall portion 232 is formed with a non-orbiting scroll positioning surface F2, which is configured as an entire circle cylindrical surface, so as to be cooperated with the bearing seat positioning surface F1 (to be described in detail below) of the main bearing seat 4 to ensure the radial centering installation of the non-orbiting scroll 2 (that is, the radial movement of the non-orbiting scroll relative to the main bearing seat can be limited or prevented).

Figure 5A:
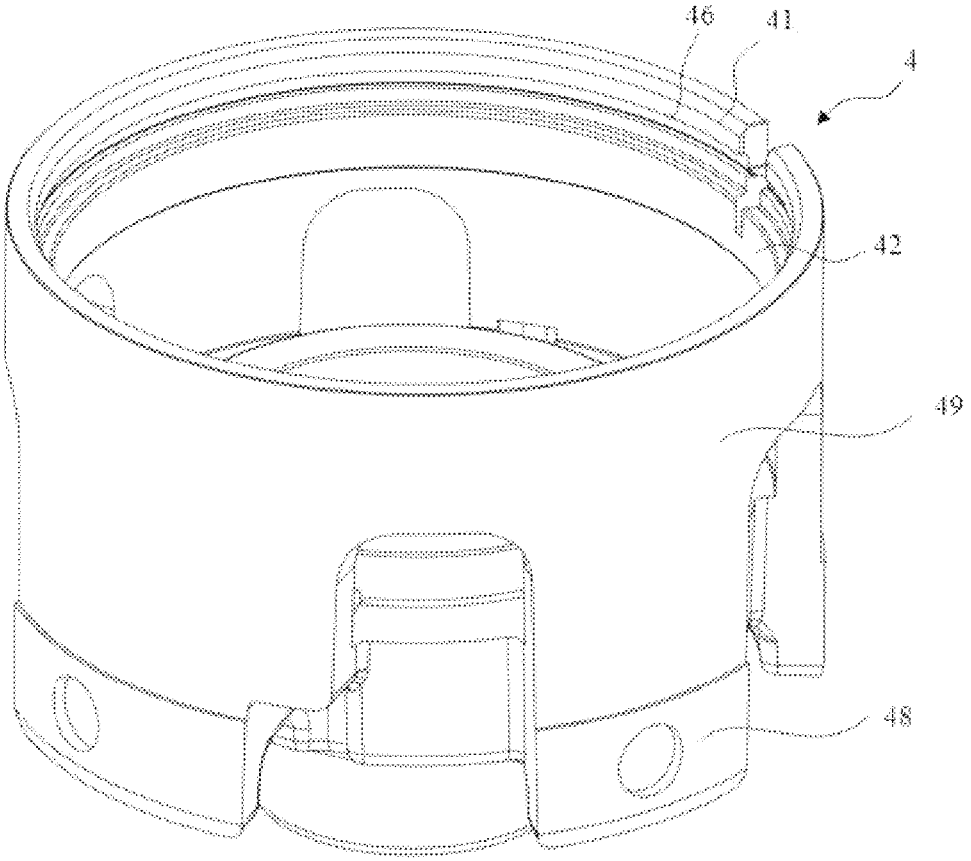
FIG. 5*a* is a schematic perspective view of the main bearing seat according to the exemplary embodiment of the present disclosure.
Figure 5B:
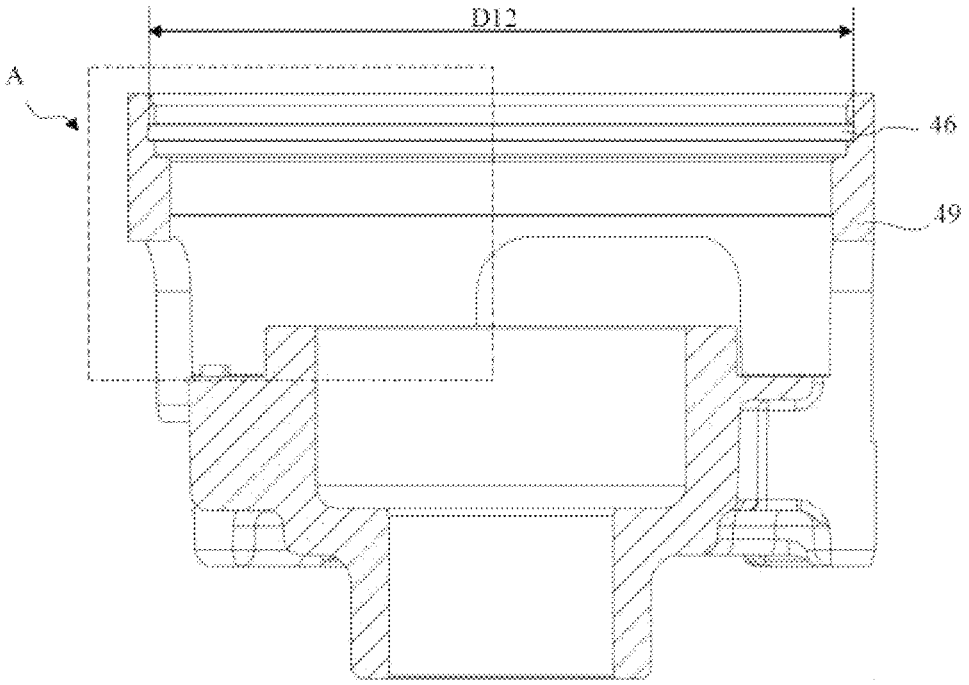
FIG. 5*b* is a longitudinal sectional view of the main bearing seat according to the exemplary embodiment of the present disclosure.
Figure 5C:
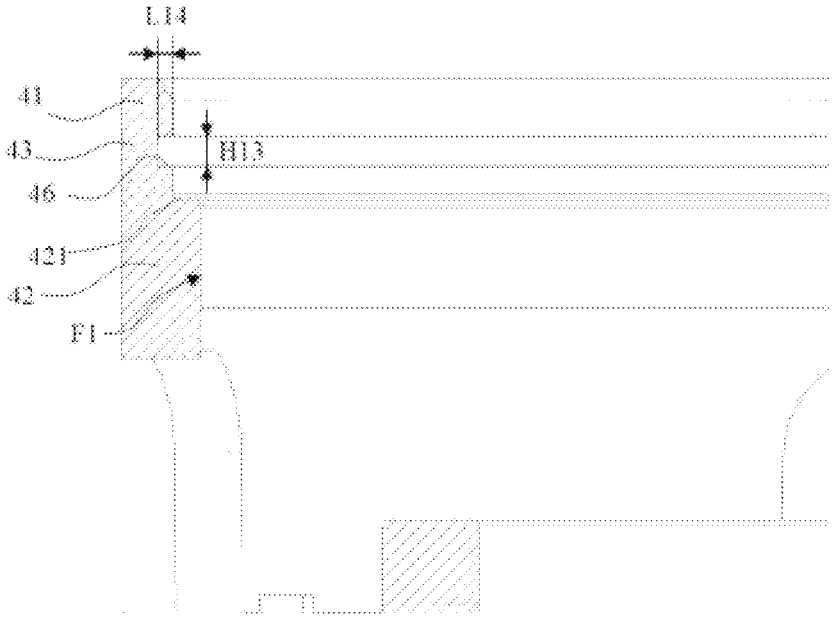
FIG. 5*c* is an enlarged detail view of part A shown in FIG. 5*b;*

Referring to the specific structure of the main bearing seat 4 shown in FIG. 5*a*, FIG. 5*b* and FIG. 5*c*, the axial seat portion 49 of the main bearing seat 4 includes a first seat portion 41 opposite to the first wall portion 231 and a second seat portion 42 opposite to the second wall portion 232, where a circumferential annular groove 46 is arranged on the first seat portion 41. The inner peripheral surface of the second seat portion 42 is formed with a bearing seat positioning surface F1 which is configured as an entire circle cylindrical surface and can be cooperated with the non-orbiting scroll positioning surface F2 as described above to realize the radial centering and radial limit of the non-orbiting scroll. A small clearance fit is provided between the non-orbiting scroll positioning surface F2 and the bearing seat positioning surface F1. It should be noted that the small clearance fit here means that the outer diameter of the second wall portion 232 where the non-orbiting scroll positioning surface F2 is formed is slightly smaller than the inner diameter of the second seat portion 42 where the bearing seat positioning surface F1 is formed, so that the second wall portion 232 of the non-orbiting scroll 2 can be freely inserted into the second seat portion 42 of the main bearing seat 4 along the axial direction, while the radial movement of the non-orbiting scroll 2 relative to the main bearing seat 4 is restricted or basically restricted after the insertion.

In addition, the second seat portion 42 may also be formed with a second step portion 421, the second step portion 421 is adjacent to the circumferential annular groove 46 and is arranged below the circumferential annular groove 46 to support and/or accommodate the first step portion 233 of the non-orbiting scroll 2, especially in the case where the first step portion 233 protrudes radially outward relative to the non-orbiting scroll positioning surface F2 to provide more support for the elastic ring 6. As can be understood by those skilled in the art, the axial thickness of the elastic ring 6 is smaller than the axial height H13 of the circumferential annular groove 46, so that the elastic ring 6 can be freely inserted into the circumferential annular groove 46, and after being inserted into the circumferential annular groove 46, the elastic ring 6 can move axially to a certain extent relative to the main bearing seat 4, thus realizing the axial floating of the non-orbiting scroll 2.

In addition, as can be understood by those skilled in the art, although the axial seat portion 49 of the main bearing seat 4 is shown to be substantially cylindrical in the exemplary embodiment of the present disclosure, the axial seat portion 49 may be configured in other suitable forms, such as in the form of multiple arms extending upward in the axial direction from the main body part 48; accordingly, the circumferential annular groove 46 includes partial circumferential annular grooves formed on the radially inner side walls of multiple arms for accommodating the elastic ring 6.

Figure 6A:
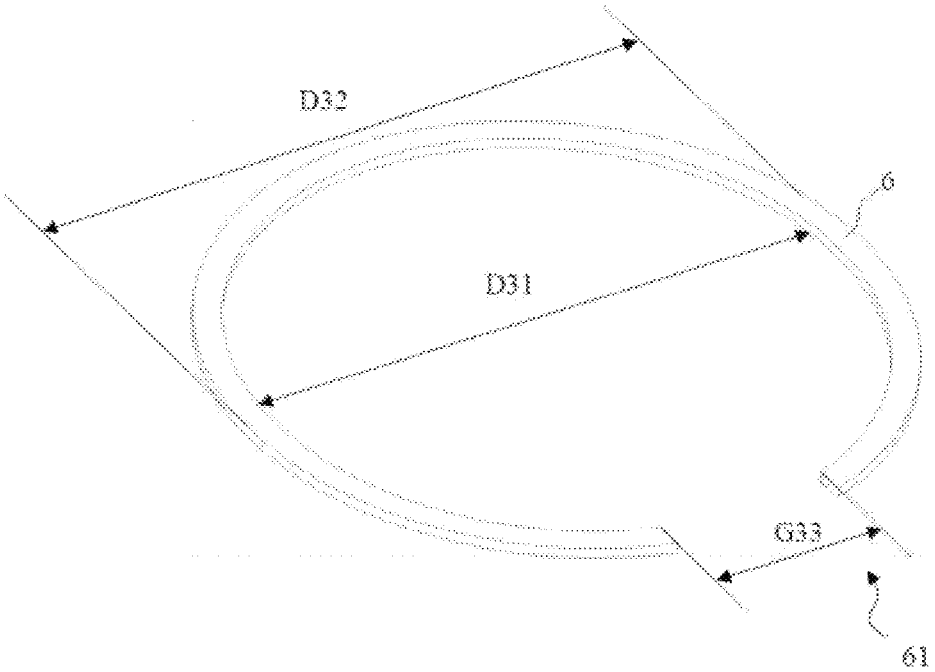
FIG. 6*a* and FIG. 6*b* are respectively a schematic perspective view of an elastic ring according to the exemplary embodiment of the present disclosure and a comparison diagram of the elastic ring before and after deformation according to the exemplary embodiment of the present disclosure.
Figure 6B:
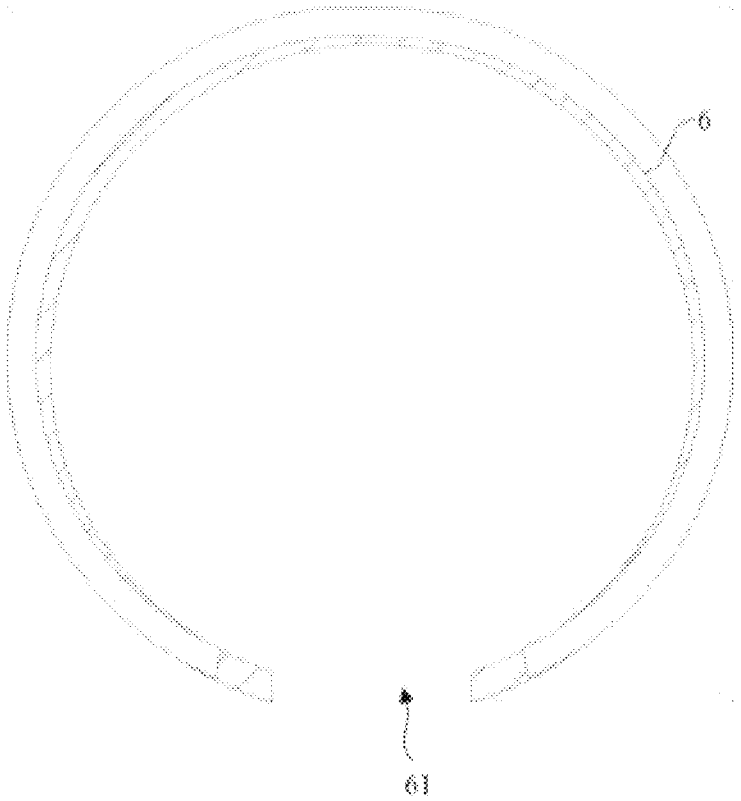

FIG. 6*a* is a three-dimensional schematic diagram of the elastic ring 6. In this disclosure, the elastic ring 6 is configured as a circular ring with an opening 61, and the elastic ring can be in a flat shape with a certain axial thickness, with an inner diameter D31 and an outer diameter D32. That is, both end faces of the elastic ring 6 in the axial direction may be configured as planes so as to be suitable for matching with the first step portion 233 and the circumferential annular groove 46, thereby it is easy to control the amount of axial floating more accurately. The elastic ring 6 can be made of spring steel with certain elasticity, and with the opening 61, the elastic ring 6 can expand or contract and deform under the radial external force, while it is ensured that the elastic ring itself has a certain rigidity and can be used to be cooperated with the circumferential annular groove 46 for axial limit. For example, as shown in FIG. 6*b*, the shaded part represents the elastic ring 6 in its free state, under the radial external force, the elastic ring 6 expands and deforms to reach the state indicated by the unshaded part. That is, the dimension of external contour of the elastic ring 6 increases, and the width G33 of the opening 61 also increases. Of course, the elastic ring 6 may also contract under the action of external force, so that the elastic ring 6 can be removed from the circumferential annular groove 46 to facilitate the removal, reinstallation and replacement of components of the compressor.

Figure 7A:
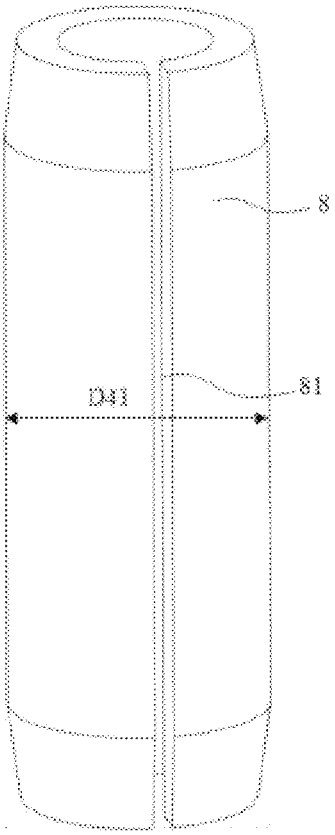
FIG. 7*a* and FIG. 7*b* respectively show an expansion pin according to an exemplary embodiment of the present disclosure and according to a modified example thereof.

FIG. 7*a* is a three-dimensional schematic diagram of the expansion pin 8. The expansion pin 8 is configured as a hollow spring pin with two open ends, the external contour of the expansion pin is configured as a substantially cylindrical shape with a diameter of D41, and is used for matching with the mounting hole 28 on the non-orbiting scroll 2. It can be understood by those skilled in the art that the number of expansion pins 8 can correspond to the number of mounting holes 28, specifically is at least two. The outer diameter D41 of the expansion pin 8 is equal to or slightly larger than the diameter of the mounting hole 28, so that the expansion pin 8 interference-fits in the mounting hole 28. Preferably, the expansion pin 8 further has a longitudinal slot 81, so that the expansion pin itself has certain elasticity and can be easily inserted into the mounting hole 28 to form an interference fit. Preferably, both ends of the expansion pin 8 can further be formed in a tapered shape, which makes it easier for the expansion pin 8 to be inserted into the mounting hole 28. When the expansion pin 8 is inserted into the mounting hole 28, a part of the expansion pin 8 is accommodated in the mounting hole 28, and the other part of the expansion pin 8 is located outside the mounting hole 28 and above the first step portion 233, so as to apply a radial force to the elastic ring 6.

Figure 7B:
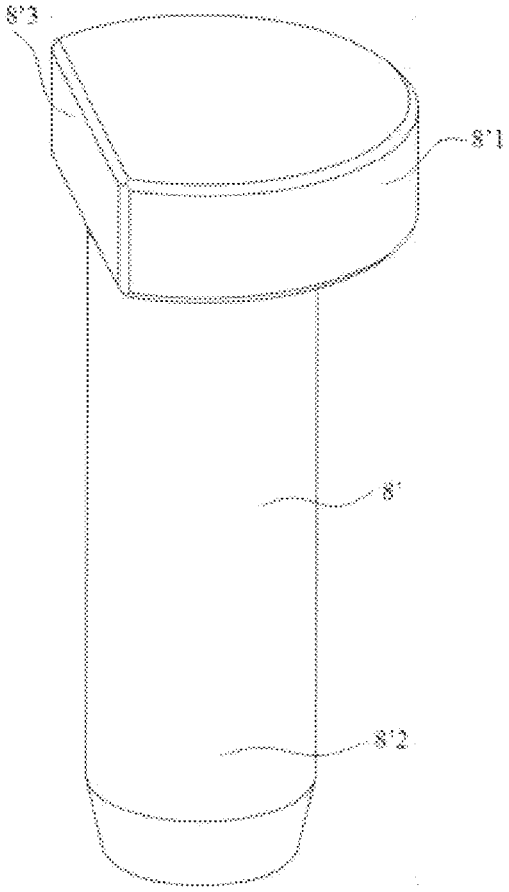

In addition, FIG. 7*b* shows the expansion pin 8' in a modified example. The expansion pin 8' includes a head 8'1 and a rod 8'2, the head 8'1 is formed with a flat part 8'3 extending in the axial direction of the expansion pin 8'. The flat part 8'3 is configured to be suitable to fit with the cutting part 25 of the first wall portion 231 of the non-orbiting scroll 2. When the expansion pin 8' is inserted into the mounting hole 28, the flat part 8'3 can be opposite to the cutting part 25, making it easier for the expansion pin 8' to align with the mounting hole 28, to be assembled and to be inserted and making the expansion pin 8' more stable. After the expansion pin 8' is fitted into the mounting hole 28, a part of the expansion pin rod 8'2 is received in the mounting hole 28 and is in interference fit with the mounting hole 28, the remaining part of the expansion pin rod 8'2 and the head 8'1 are located outside the mounting hole 28 and above the first step portion 233, the rod 8'2 abuts against the radially inner side wall of the elastic ring 6, and exerts a force in the radial direction on the elastic ring 6.

As can be understood by those skilled in the art, the expansion pin may be formed not only as a spring pin with a smooth cylindrical outer contour to be interference-fitted with the mounting hole 28 (as shown in FIG. 7*a*), but also as a cylindrical positioning pin with external threads or positioning pin with external threads (not shown), internal threads matching with the external threads on the surface of the expansion pin are formed on the inner surface of the mounting hole 28, so that the expansion pin can be assembled into the mounting hole 28 by screwing, thereby the mounting process is more convenient.

In addition, in the present disclosure, the pushing structure is not limited to include the mounting hole 28 and the expansion pin as described in the exemplary embodiment, the pushing structure may include any other structure that can force the elastic ring 6 to expand radially outward and maintain the expanded state. For example, the pushing structure may include a convex structure integrally formed with the non-orbiting scroll, the convex structure can exert a radially outward force on the elastic ring 6 to expand the elastic ring 6 and hold the elastic ring 6 in the circumferential annular groove 46.

Figure 9A:
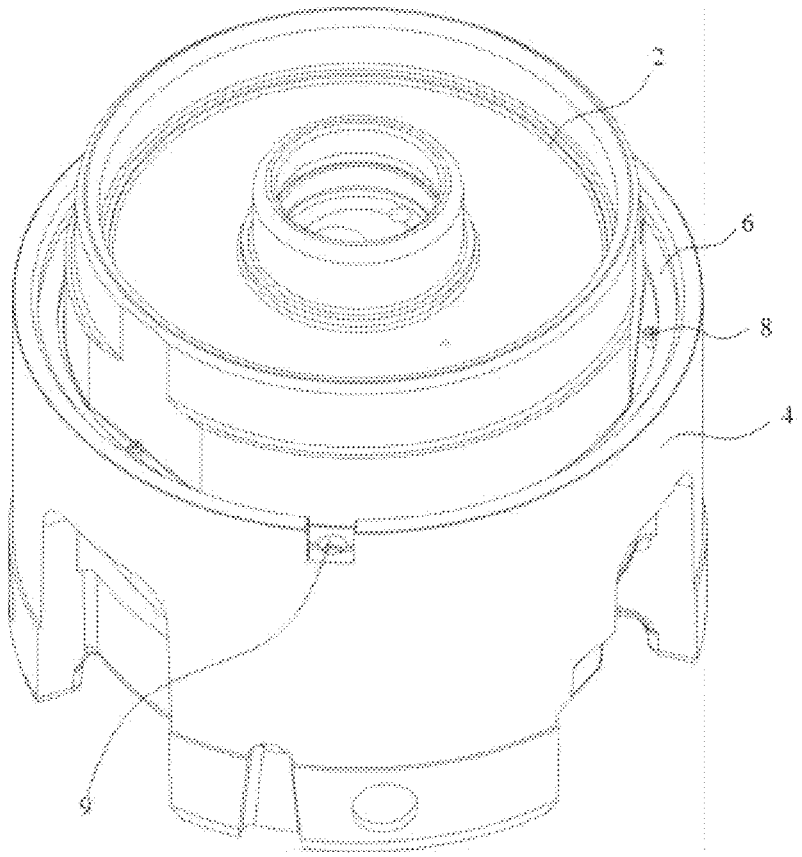
FIG. 9*a* and FIG. 9*b* are respectively an assembled schematic perspective view and a top view of the scroll mechanism and the main bearing seat according to an exemplary embodiment of the present disclosure, in which a circumferential limit structure is shown.
Figure 9B:
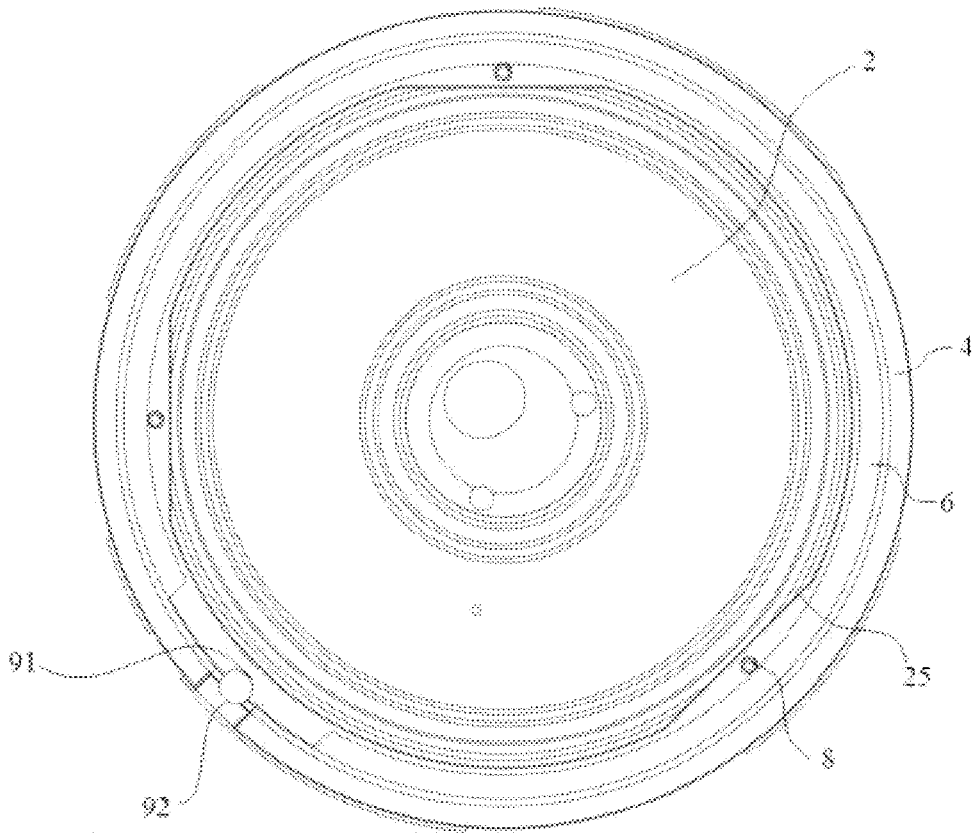

In an exemplary embodiment according to the present disclosure, in order to limit the position of the non-orbiting scroll 2 in the circumferential direction, referring to FIG. 9*a* and FIG. 9*b*, a first semi-circular groove 91 may be provided on the radially outer side of the outer peripheral wall 23 of the non-orbiting scroll 2, and the first semi-circular groove 91 may be formed on the radially outer side of the first step portion 233. In addition, a second semi-circular groove 92 is provided on the radially inner side of the axial seat portion 49 of the main bearing seat 4, the second semi-circular groove 92 may be provided on the radially inner side of the second step portion 421. The first semi-circular groove 91 and the second semi-circular groove 92 can be cooperated with each other to form an entire circular-hole shaped groove 9. By inserting the anti-rotation pin into the circular-hole shaped groove 9, the non-orbiting scroll 2 can be prevented from rotating relative to the main bearing seat 4 (that is, the circumferential movement of the non-orbiting scroll 2 relative to the main bearing seat 4 can be restricted or prevented). It should be noted that in order to avoid interference with the elastic ring 6 when mounting the anti-rotation pin, the circular-hole shaped groove 9 is arranged at the position corresponding to the opening 61 of the elastic ring 6. This circumferential limit structure not only occupies a small radial space, but also has a simple structure and is easy to process and assemble.

Figure 8A:
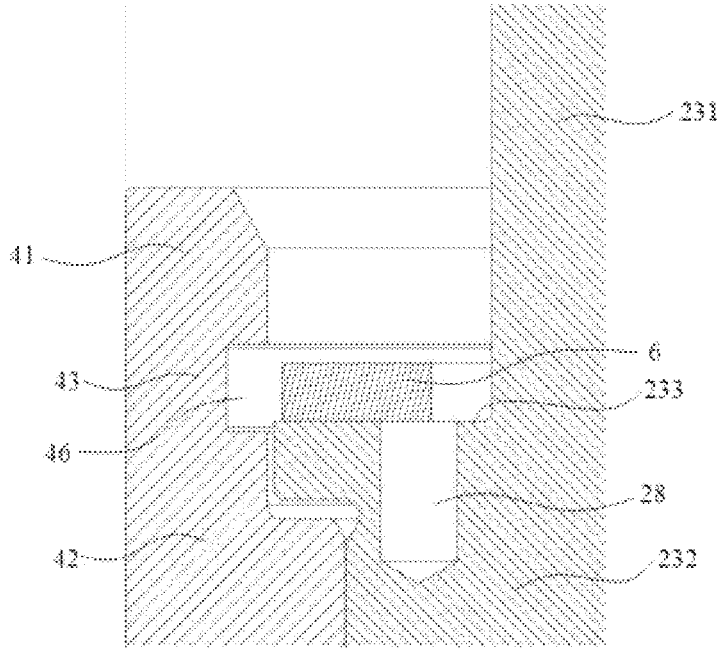
FIG. 8*a*, FIG. 8*b* and FIG. 8*c* show a process of mounting an elastic ring in place via an expansion pin according to an exemplary embodiment of the present disclosure.
Figure 8B:
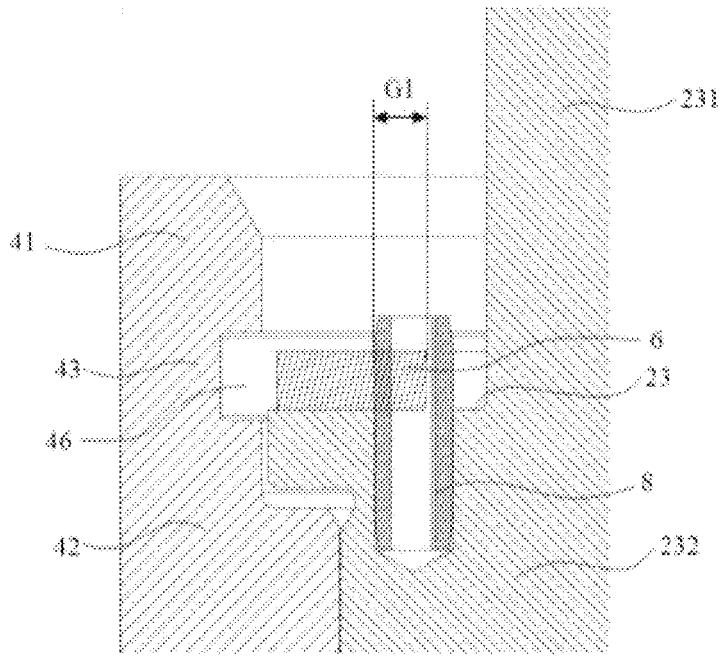

The assembling method of the non-orbiting scroll 2 according to the exemplary embodiment of the present disclosure is described below with reference to FIG. 8*a*, FIG. 8*b* and FIG. 8*c*.

First, the non-orbiting scroll 2 is slid into the main bearing seat 4 in the axial direction to form a small clearance fit between the second wall portion 232 of the non-orbiting scroll 2 and the second seat portion 42 of the main bearing seat 4, so as to realize the radial centering of the non-orbiting scroll 2, and the first semi-circular groove 91 needs to be aligned with the second semi-circular groove 92 to form a complete circular-hole shaped groove 9.

Next, the elastic ring 6 is placed downward on the first step portion 233 of the non-orbiting scroll 2 from above the non-orbiting scroll 2. As can be understood by those skilled in the art, the inner diameter D31 of the elastic ring 6 is larger than the outer diameter D21 of the first wall portion of the non-orbiting scroll 2, the outer diameter D32 of the elastic ring 6 is smaller than the inner diameter D11 of the first seat portion 41 of the main bearing seat 4, and it can be ensured that the elastic ring 6 would not interfere with the non-orbiting scroll 2 and the main bearing seat 4 when assembling the elastic ring, so that the elastic ring 6 can be easily placed from top to bottom to a proper position.

Then, after the elastic ring 6 is placed on the first step portion 233 and the elastic ring 6 is radially centered, multiple expansion pins 8 are sequentially inserted into the corresponding mounting holes 28 from the radially inner side of the elastic ring 6. Specifically, referring to FIG. 8*b*, when mounting a first one of the expansion pins 8, the elastic ring 6 is in a free state, the mounting hole 28 (or the expansion pin 8) partially overlaps the elastic ring 6 in the radial direction, and the radial length of the overlapping part is the first dimension G1; after the first expansion pin 8 is inserted into the mounting hole 28, the expansion pin 8 abuts against the radially inner side wall of the elastic ring 6 and exerts a radially outward force on the elastic ring 6, so that the elastic ring 6 moves radially outward into the circumferential annular groove 46 of the main bearing seat 4; when mounting the remaining expansion pin(s) 8, the elastic ring 6 can be expanded with the help of corresponding tooling, so that the elastic ring 6 expands and deforms outward in the radial direction, thereby the remaining expansion pin(s) 8 can be easily inserted into the corresponding mounting holes 28. It should be noted that under the external force exerted by the corresponding tooling, the elastic ring 6 expands and its opening 61 also increases, and the degree of increase is controlled by the tooling, so as not to affect the smooth mounting of the expansion pins 8.

Figure 8C:
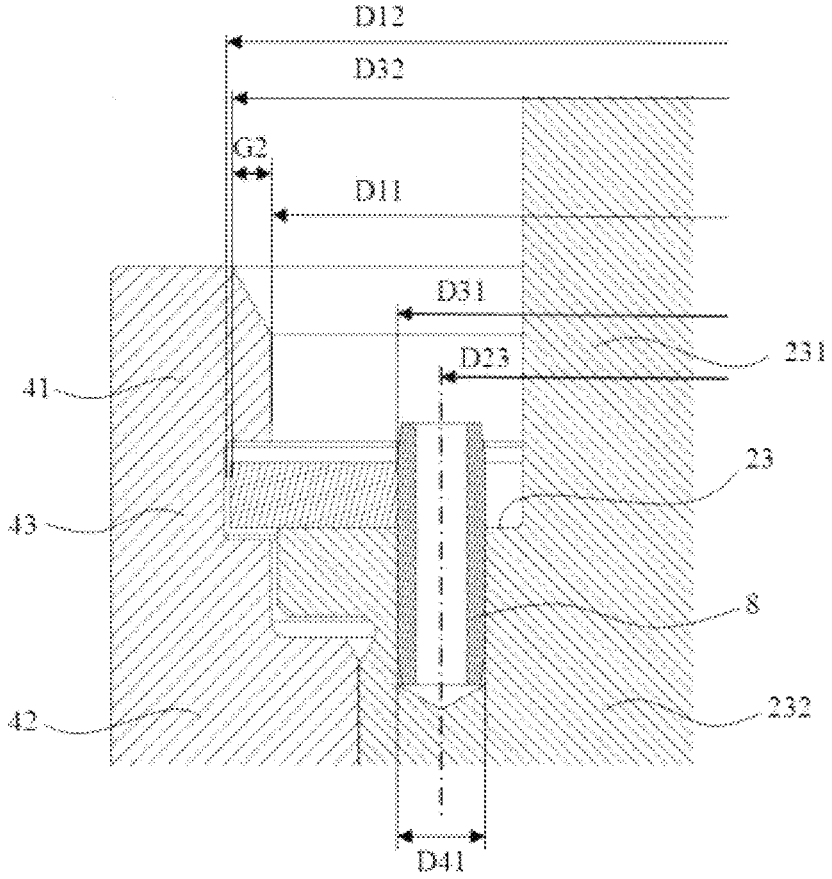

Referring to FIG. 8*c*, after all the expansion pins 8 are inserted into the mounting holes 28 and the elastic ring 6 is fitted in the circumferential annular groove 46 through expansion deformation; a part of the elastic ring 6 is located in the circumferential annular groove 46, thereby limiting the axial floating of the non-orbiting scroll 2. The elastic ring 6 partially overlaps the circumferential annular groove 46 in the radial direction, and the radial length of the overlapping part is the second dimension G2. That is, the radial length of the part of the elastic ring 6 located in the circumferential annular groove 46 is the second dimension G2, which is smaller than the radial depth L14 of the circumferential annular groove 46 and larger than half (½) of the radial depth L14 of the circumferential annular groove 46, so as to ensure that the elastic ring 6 can stably float up and down in the circumferential annular groove 46 without slipping out of the groove.

In addition, after the elastic ring 6 is installed in position in the circumferential annular groove 46 by expansion deformation, the radial width of the elastic ring 6 is smaller than the difference between the radius of the circumferential annular groove 46 and the radial distance from the radial outer side wall of the expansion pin 8 abutting against the elastic ring 6 to the axis of the non-orbiting scroll 2. Referring to FIG. 8*c*, the radial width of the elastic ring can be calculated by half the difference between the outer diameter D32 and the inner diameter D31 of the elastic ring 6, that is, (D32−D31)×0.5; the radius of the circumferential annular groove 46 can be calculated by half the diameter D12 of the circumferential annular groove 46, that is, D12×0.5; the radial distance from the radial outer side wall of the expansion pin 8 abutting against the elastic ring 6 to the axis of the non-orbiting scroll 2 can be calculated by the sum of half the diameter D23 of the circle where the mounting hole 28 is located and half the diameter D41 of the expansion pin 8, that is, D23×0.5+D41×0.5. That is, the radial width of the elastic ring 46 should satisfy the following relationship:

$$(D32-D31)\times 0.5<D12\times 0.5-(D23\times 0.5+D41\times 0.5)$$

In addition, after the elastic ring 6 is mounted in place in the circumferential annular groove 46 through expansion deformation, the axial thickness of the elastic ring 46 is obviously smaller than the circumferential height H13 of the circumferential annular groove 46; however, the specific height dimension of the elastic ring needs to be determined according to the specific axial floating of the non-orbiting scroll allowed in the scroll compressor.

Finally, after all the expansion pins 8 are inserted into the mounting holes 28 and the elastic ring 6 is mounted in place in the circumferential annular groove 46 through expansion deformation, the tooling is removed, the elastic ring 6 is held in place in the circumferential annular groove 46 by the expansion pins 8. Then, the anti-rotation pin is inserted into the circular-hole shaped groove 9 from top to bottom, so as to realize the circumferential positioning of the non-orbiting scroll. Because the circular-hole shaped groove 9 is located in the opening 61 of the elastic ring 6 after the elastic ring 6 is mounted in position in the circumferential annular groove 46, the anti-rotation pin may not interfere with the elastic ring 6 during the insertion of the anti-rotation pin into the circular-hole shaped groove 9.

In the exemplary embodiment of the present disclosure, the radial centering of the non-orbiting scroll can be realized through the small clearance fit between the bearing seat positioning surface F1 and the non-orbiting scroll positioning surface F2, the axial limit and floating of the non-orbiting scroll can be realized through the clearance fit between the elastic ring 6 and the circumferential annular groove 46, and the circumferential limit of the non-orbiting scroll can be realized through the cooperation of the anti-rotation pin and the circular-hole shaped groove 9; compared with the axial flexible fastening structure in which the lug of the non-orbiting scroll cooperates with the fastener having the guide sleeve, or the axial flexible fastening structure in which the guide ring cooperates with the fastener, the design of the present disclosure can save the radial space occupied by the axial flexible fastening structure, thus facilitating the increase of the displacement of the scroll without increasing the size of the compressor and thereby being beneficial to the miniaturization of the compressor.

Furthermore, in the exemplary embodiment of the present disclosure, the elastic ring 6 is firstly mounted on the non-orbiting scroll 2 in a free state and then mounted in the circumferential annular groove 46 through expansion and deformation, compared with the mode that the elastic ring is firstly compressed and then mounted in the groove by releasing, the compression step can be avoided, especially in the case that the elastic ring has large size and is difficult to compress, which causes assembly difficulties, this mounting mode makes the elastic ring easier to mount, and also facilitates the assembly, disassembly, reinstallation, replacement and the like of components of the scroll compressor.

Various possible modifications are permissible in the present disclosure. For example, in the above embodiment, it is described that the circumferential annular groove is formed in the main bearing seat. However, it can be understood that the circumferential annular groove can also be formed on other suitable fixing parts; for example, the circumferential annular groove is directly formed on the housing (such as the housing body) (in this case, it can be considered to provide a thickened part on the corresponding part of the housing body to facilitate the formation of the circumferential annular groove), or the circumferential annular groove is formed on a fixed member fixedly connected with the housing and/or the main bearing seat (such as a member similar to a guide ring).

While various embodiments of the present disclosure have been described herein in detail, it is conceivable that the present disclosure is not limited to the specific embodiments described and illustrated herein in detail, and other variations and modifications can be implemented by the person skilled in the art without departing from the essence and scope of the present disclosure. All these modifications and variations fall within the scope of the present disclosure. Moreover, all the members described herein can be replaced by other technically equivalent members.

The invention claimed is:

1. A scroll compressor, comprising:

a scroll mechanism, wherein the scroll mechanism comprises a non-orbiting scroll, the non-orbiting scroll comprises a non-orbiting scroll end plate and a non-orbiting scroll wrap and an outer peripheral wall extending from one side of the non-orbiting scroll end plate, the outer peripheral wall is arranged at a periphery of the non-orbiting scroll wrap; and a main bearing seat, wherein the main bearing seat is configured for supporting the scroll mechanism and comprises a main body part and an axial seat portion extending axially from the main body part, a circumferential annular groove is formed at an inner peripheral surface of the axial seat portion, wherein the scroll compressor further comprises an elastic ring arranged between the outer peripheral wall and the axial seat portion and a pushing structure located at a radial inner side of the elastic ring and configured for forcing the elastic ring to expand radially outward, so that a part of the elastic ring in a radial direction is inserted in the circumferential annular groove to limit axial movement of the non-orbiting scroll away from the main bearing seat.

2. The scroll compressor according to claim 1, wherein the outer peripheral wall, along an axial direction, comprises a first wall portion and a second wall portion, a step portion is provided between the first wall portion and the second wall portion, and the elastic ring is arranged on the step portion.

3. The scroll compressor according to claim 2, wherein the pushing structure comprises a mounting hole provided at the step portion and an expansion pin which is mounted in the mounting hole and is configured for pushing the elastic ring radially outward.

4. The scroll compressor according to claim 3, wherein the first wall portion is provided with a cutting part at a position corresponding to the mounting hole.

5. The scroll compressor according to claim 2, wherein the main bearing seat, along the axial direction, comprises a first seat portion and a second seat portion, the first seat portion is provided with the circumferential annular groove and is arranged opposite to the first wall portion, the second seat portion is arranged opposite to the second wall portion, an inner peripheral surface of the second seat portion cooperates with an outer peripheral surface of the second wall portion to limit radial movement of the non-orbiting scroll relative to the main bearing seat.

6. The scroll compressor according to claim 5, wherein an outer diameter of the elastic ring in its free state is smaller than an inner diameter of the first seat portion, an inner diameter of the elastic ring is larger than an outer diameter of the first wall portion.

7. The scroll compressor according to claim 3, wherein the expansion pin is configured as a hollow spring pin with openings at both ends and having a longitudinal slot, as a cylindrical positioning pin provided with external threads, or as a positioning pin with a head at one end and a flat part extending in an axial direction of the expansion pin at the head.

8. The scroll compressor according to claim 1, wherein the elastic ring is configured as a circular ring with an opening.

9. The scroll compressor according to claim 1, wherein a radial dimension of the part of the elastic ring located in the circumferential annular groove is greater than ½ of a radial depth of the circumferential annular groove.

10. The scroll compressor according to claim 1, wherein an axial thickness of the elastic ring is smaller than an axial height of the circumferential annular groove.

11. The scroll compressor according to claim 1, wherein the elastic ring is configured not to be fixed to the non-orbiting scroll or the main bearing seat, so that it can float in an axial direction along with axial movement of the non-orbiting scroll.

12. The scroll compressor according to claim 1, wherein a first semi-circular groove and a second semi-circular groove are respectively formed on an outer peripheral surface of the outer peripheral wall and the inner peripheral surface of the axial seat portion, the first semi-circular groove and the second semi-circular groove cooperate with each other to form a circular-hole shaped groove, and an anti-rotation pin accommodated in the circular-hole shaped groove is provided, thereby limiting circumferential movement of the non-orbiting scroll relative to the main bearing seat.

13. An assembly method for assembling the non-orbiting scroll of the scroll compressor according to claim 1, comprising:

arranging the non-orbiting scroll into the main bearing seat; and arranging the elastic ring on a step portion provided at the outer peripheral wall of the non-orbiting scroll, wherein the assembly method further comprises: inserting an expansion pin of the pushing structure into a mounting hole, arranged at the step portion, of the pushing structure from the radial inner side of the elastic ring, so that the elastic ring expands radially outward and a part of the elastic ring in the radial direction is inserted in the circumferential annular groove formed at the inner peripheral surface of the axial seat portion of the main bearing seat.

14. The assembly method according to claim 13, comprising:

when arranging the non-orbiting scroll into the main bearing seat, aligning a first semi-circular groove formed on an outer peripheral surface of the outer peripheral wall and a second semi-circular groove formed on the inner peripheral surface of the axial seat portion to form a circular-hole shaped groove, and the assembly method further comprising inserting an anti-rotation pin into the circular-hole shaped groove.

15. The assembly method according to claim 13, wherein the step of inserting the expansion pin into the mounting hole from the radial inner side of the elastic ring comprises: after a first one of the expansion pins is inserted into the mounting hole, expanding the elastic ring radially outward by using a tooling, and removing the tooling after the remaining expansion pin(s) is/are all inserted into its/their corresponding mounting hole(s).

* * * * *